US009238297B2

(12) United States Patent
Sakai et al.

(10) Patent No.: US 9,238,297 B2
(45) Date of Patent: Jan. 19, 2016

(54) ACTUAL GRINDING DEPTH MEASUREMENT METHOD, MACHINING METHOD, AND MACHINE TOOL

(71) Applicant: JTEKT Corporation, Osaka-shi (JP)

(72) Inventors: Toshiki Sakai, Kariya (JP); Masashi Yoritsune, Anjo (JP); Yasuo Niino, Toyokawa (JP)

(73) Assignee: JTEKT CORPORATION, Osaka-shi (JP)

( * ) Notice: Subject to any disclaimer, the term of this patent is extended or adjusted under 35 U.S.C. 154(b) by 403 days.

(21) Appl. No.: 13/681,852

(22) Filed: Nov. 20, 2012

(65) Prior Publication Data

US 2013/0137341 A1 May 30, 2013

(30) Foreign Application Priority Data

Nov. 28, 2011 (JP) ..... 2011-259121

(51) Int. Cl.

| | |
|---|---|
| ***B24B 49/02*** | (2006.01) |
| ***B24B 5/04*** | (2006.01) |
| ***B24B 41/06*** | (2012.01) |
| ***B24B 49/04*** | (2006.01) |

(52) U.S. Cl.

CPC . *B24B 49/02* (2013.01); *B24B 5/04* (2013.01); *B24B 41/062* (2013.01); *B24B 49/04* (2013.01)

(58) Field of Classification Search

CPC ..... B24B 49/02; B24B 49/04; B24B 41/06; B24B 5/04

USPC ..... 451/5, 8, 9, 10, 49

See application file for complete search history.

(56) References Cited

U.S. PATENT DOCUMENTS

| | | | | |
|---|---|---|---|---|
| 4,053,289 | A | 10/1977 | Tatsumi | |
| 6,098,452 | A | 8/2000 | Enomoto et al. | |
| 6,234,869 | B1 | 5/2001 | Kobayashi et al. | |
| 2010/0105289 | A1 * | 4/2010 | Yonezu et al. | 451/5 |
| 2011/0097971 | A1 * | 4/2011 | Kumeno et al. | 451/5 |

FOREIGN PATENT DOCUMENTS

| | | | |
|---|---|---|---|
| EP | 2 181 802 | A1 | 5/2010 |
| EP | 2 316 612 | A2 | 5/2011 |
| JP | 2-224971 | | 9/1990 |
| WO | WO 2011/085913 | A1 | 7/2011 |

OTHER PUBLICATIONS

Extended European Search Report issued Nov. 4, 2013 in Patent Application No. 12193941.7.

* cited by examiner

*Primary Examiner* — Robert Rose

(74) *Attorney, Agent, or Firm* — Oblon, McClelland, Maier & Neustadt, L.L.P.

(57) ABSTRACT

In a machining method of supporting a workpiece having a cylindrical machined portion such that the workpiece is rotatable and feeding a grinding wheel in a radial direction, a start diameter that is a diameter including a measurement start point on a surface of the machined portion is measured, and, after the measurement start point passes through a machining application portion, an end diameter that is a diameter including a measurement end point is measured. An actual grinding depth at the time when the measurement start point is machined is computed by the equation, U=|D0−D1|, a runout of the machined portion is computed from a relative difference in the actual grinding depth (U) between positions of the machined portion in a rotational direction, and infeed control of the grinding wheel is executed such that the runout is removed.

6 Claims, 7 Drawing Sheets

(θ =0°)

(θ =270°)

(θ =360°)

(θ =450°)

ACTUAL GRINDING DEPTH MEASUREMENT METHOD, MACHINING METHOD, AND MACHINE TOOL

INCORPORATION BY REFERENCE/RELATED APPLICATION

This application claims priority to Japanese Patent Application No. 2011-259121 filed on Nov. 28, 2011 the disclosure of which, including the specification, drawings and abstract, is incorporated herein by reference in its entirety.

BACKGROUND OF THE INVENTION

1. Field of the Invention

The invention relates to an actual grinding depth measurement method of measuring an actual grinding depth in a workpiece, which is achieved by a tool while a cylindrical machined portion of the workpiece is being machined, and relates also to a machining method and a machine tool.

2. Discussion of Background

During machining, deflection of a workpiece occurs due to machining resistance. Accordingly, an infeed of a tool with respect to the workpiece (an infeed of the tool per one rotation of the workpiece) usually does not coincide with an actual grinding depth (an actual amount of reduction in the radius of the workpiece). Therefore, the diameter of the workpiece during machining is measured and a machining process is controlled based on the measured diameter. For example, Japanese Patent Application Publication No. 2-224971 (JP 2-224971 A) suggests an adaptive control grinding method in which an actually measured value of the diameter of a workpiece per one rotation of the workpiece is used, and U.S. Pat. No. 4,053,289 suggests a grinding process control in which an actual grinding depth calculated from an actually measured value of the diameter of a workpiece per one rotation of the workpiece is used.

In the case where an actual grinding depth UJ is calculated from an actually measured value of the diameter of a workpiece per one rotation, when the diameter of the workpiece in the first measurement is DJ0 and the diameter of the workpiece after one rotation of the workpiece is DJ1, the actual grinding depth UJ is calculated according to the equation, UJ=(DJ0−DJ1)/2. The actual grinding depth UJ is calculated as described above on the assumption that the entire circumference of the workpiece is machined during one rotation of the workpiece and, therefore, the material of the workpiece is removed at both ends in the measurement diameter and the actual grinding depth UJ is the same at the both ends. However, if the infeed speed varies or the machining resistance varies, the actual grinding depth varies even during one rotation, so an error is contained in the actual grinding depth calculated using the mean value. Therefore, in the machining process control in which the actual grinding depth calculated using the mean value is used, there is a possibility that sufficient advantageous effects will not be obtained due to the influence of the error.

SUMMARY OF THE INVENTION

The invention provides a machine tool that easily measures an accurate actual grinding depth in a machined portion during machining and that controls a machining process using the actual grinding depth.

According to a feature of an example of the invention, there are provided a diameter measurement start step of measuring a start diameter (D0) that is a distance between a measurement start point and a measurement end point; a diameter measurement end step of measuring an end diameter (D1) that is a diameter of a machined portion, the end diameter including the measurement end point, after the measurement start point passes through a machining application portion and before the measurement end point passes through the machining application portion; and an actual grinding depth computing step of computing an actual grinding depth (U) at the time when the measurement start point is machined, according to the equation, U=|D0−D1|.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Hereinafter, embodiments of the invention will be described with reference to the accompanying drawings.

Figure 1:
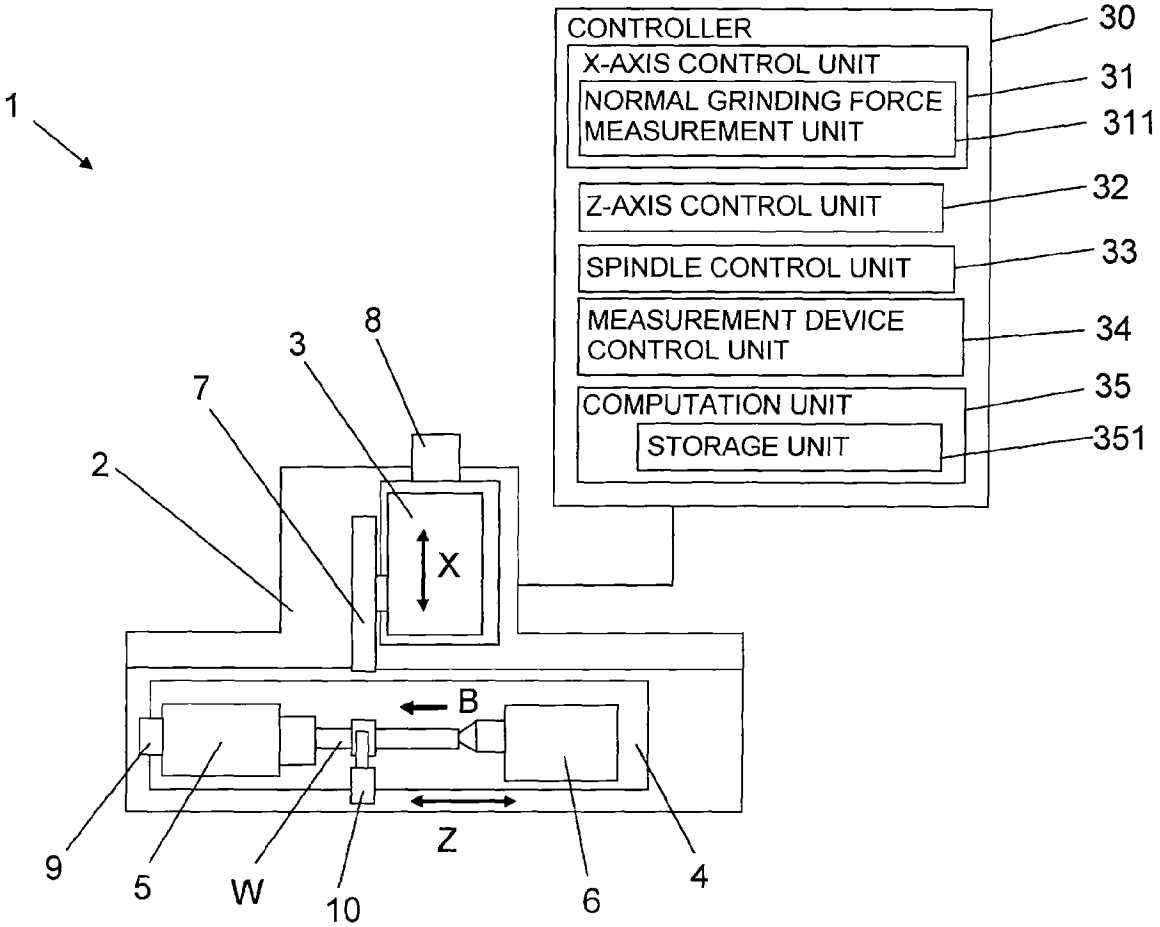
FIG. 1 is the overall configuration of a grinding machine according to an embodiment of the invention.

As shown in FIG. 1, an external cylindrical grinding machine 1 includes a bed 2, a grinding wheel head 3, and a table 4. The grinding wheel head 3 is supported on the bed 2 so as to be able to reciprocate in the direction of an X-axis, and is driven by a feed motor 8. The table 4 is able to reciprocate in the direction of a Z-axis that is perpendicular to the X-axis. A grinding wheel 7 is rotatably supported by the grinding wheel head 3. The grinding wheel 7 is rotated by a grinding wheel spindle rotation motor (not shown). A spindle 5 and a tailstock 6 are mounted on the table 4. The spindle 5 holds and supports one end of a workpiece W such that the workpiece W is rotatable. The spindle 5 is rotated by a spindle motor (not shown). The spindle 5 is provided with a phase detector 9 that detects the rotation phase of the spindle 5. The tailstock 6 supports the other end of the workpiece W such that the workpiece W is rotatable. The workpiece W is supported by the spindle 5 and the tailstock 6, and is rotated at the time of grinding. A workpiece diameter measurement device 10 is mounted on the table 4. The workpiece diameter measurement device 10 measures the diameter of a machined portion of the workpiece W.

Figure 2:
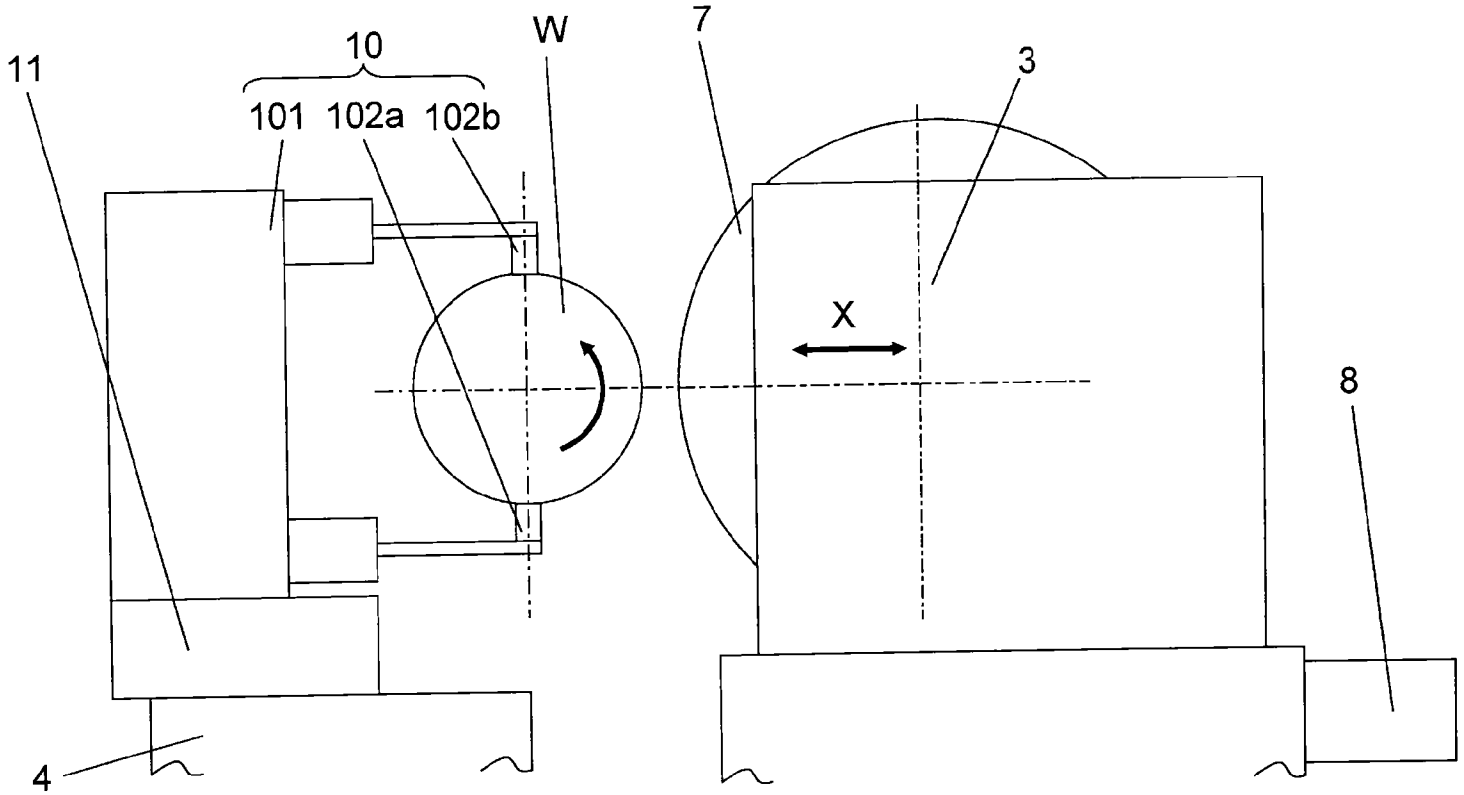
FIG. 2 is a view of the grinding machine as viewed from the direction indicated by an arrow B in FIG. 1.

As shown in FIG. 2, the workpiece diameter measurement device 10 includes a diameter measurement device body 101 and contactors 102*a*, 102*b*. The diameter measurement device body 101 is held on a base 11 that is fixed to the table 4. The contactors 102*a*, 102*b* engage with the diameter measurement device body 101, and are arranged so as to be 180° apart from each other about the shaft center of the workpiece W.

The external cylindrical grinding machine 1 includes a controller 30. The controller 30 includes, for example, an X-axis control unit 31, a Z-axis control unit 32, a spindle control unit 33, a measurement device control unit 34, and a computation unit 35. The X-axis control unit 31 controls the feed of the grinding wheel head 3. The Z-axis control unit 32 controls the feed of the table 4. The spindle control unit 33 controls the rotation of the spindle 5. The measurement device control unit 34 controls the workpiece diameter measurement device 10. The computation unit 35 incorporates therein a storage unit 351, and computes an actual grinding depth and an amount of runout. The X-axis control unit 31 has, as its function, a normal grinding force measurement unit 311 that measures a normal grinding force that acts on the grinding wheel 7 during grinding, on the basis of a current value of the motor 8.

Figure 3A:
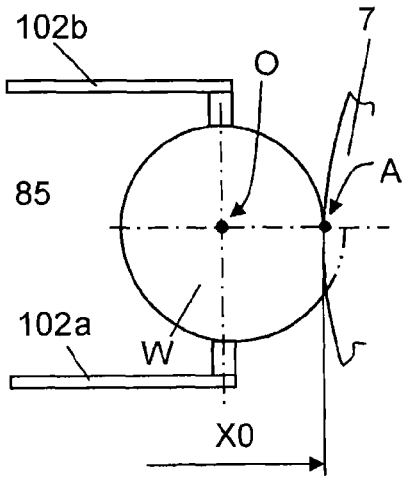
FIG. 3A to FIG. 3D show a measurement method according to the embodiment.
Figure 3B:
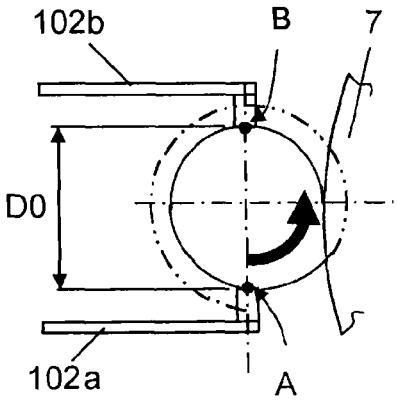
Figure 3C:
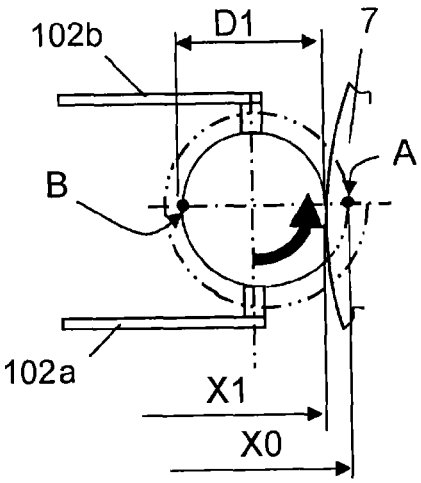
Figure 3D:
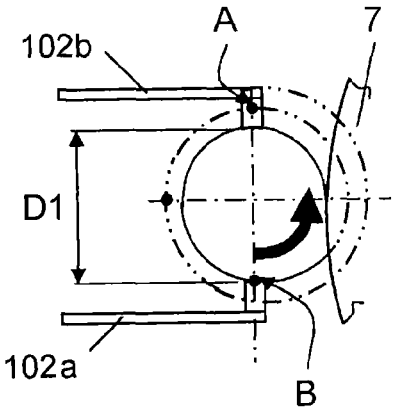

Measurement of an actual grinding depth in the workpiece W, which is achieved by the grinding wheel 7, will be described with reference to FIG. 3A to FIG. 3D that show cross sections perpendicular to the shaft center of the workpiece W at a machined position. In FIG. 3A, a point A of the workpiece W, which contacts the grinding wheel 7 at a grinding application position, is defined as a measurement start point A (an example of a measurement start point in the invention) of the workpiece W, and the phase of the workpiece W at this position is defined as 0°. As shown in FIG. 3B, a point B at a surface position of the workpiece W, which is 180° apart from the measurement start point A about the rotation axis of the workpiece W, is defined as a measurement end point B (an example of a measurement end point in the invention). A diameter measurement start process is executed when the workpiece W is rotated 270°, the measurement start point A contacts the contactor 102*a* and the measurement end point B contacts the contactor 102*b*. The diameter measurement start process is a process of measuring a workpiece diameter D0 (an example of a start diameter D0 in the invention). As shown in FIG. 3C, when the workpiece W is rotated 360°, a portion of the workpiece W at the measurement start point A is ground by the grinding wheel 7. A diameter measurement end process is a process of measuring a workpiece diameter D1 (an example of an end diameter D1 in the invention) when the workpiece W is rotated 450° and the measurement end point B contacts the contactor 102*a* as shown in FIG. 3D. Through a series of measurements described above, it is possible to measure the workpiece diameter at the measurement start point A before grinding and the workpiece diameter at the measurement start point A after grinding. Therefore, it is possible to measure an amount by which the measurement start point A is ground, that is, an actual grinding depth U in the workpiece W, which is achieved by the grinding wheel 7, by subtracting the workpiece diameter D1 from the workpiece diameter D0 (U=D0−D1).

The correlation among the actual grinding depth U, a deflection T of the workpiece W and a force that acts on the workpiece W and the grinding wheel 7 during grinding will be described below. In order to make it possible to perform grinding, the grinding wheel 7 needs to be pushed against the workpiece W with a predetermined pushing force F. The pushing force F is a force obtained by subtracting a force F0, which the grinding wheel 7 requires to cut into the workpiece W, from a force P obtained by multiplying a mechanical stiffness km, which is a spring constant between the grinding wheel 7 and the workpiece W, by a relative deflection T between the workpiece W and the grinding wheel 7. The relative deflection T is generated when the grinding wheel 7 is pushed against the workpiece W. That is, the equation, F=P−F0=T×km−F0, holds. The actual grinding depth U depends on the magnitude of the pushing force F. It is a known fact that, in normal grindings other than, for example, the case where the grinding wheel 7 is extremely abraded, the pushing force F is proportional to the actual grinding depth U. Therefore, when the constant of proportionality is a grinding stiffness kg, the equation, F=U×kg, holds. On the assumption that there are variations in the deflection and the actual grinding depth, a deviation ΔT in the deflection T is set according to the equation, ΔT=T1−T2, a deviation AU in the actual grinding depth U is set according to the equation, ΔU=U1−U2, and a deviation ΔF in the force F is set according to the equation, ΔF=F1−F2. Because the equations, F1=T1×km−F0 and F2=T2×km−F0, hold, the equation, ΔF=F1−F2=(T1×km−F0)−(T2×km−F0)=(T1−T2)km=ΔT×km, holds. In addition, because the force F is proportional to the actual grinding depth U, the deviation ΔF in the force F is proportional to the deviation ΔU in the actual grinding depth U (ΔF=ΔU×kg). As a result, the equation, ΔF=ΔT×km=ΔU×kg, holds, and therefore the equation, ΔT=ΔU×kg/km, holds.

Next, the correlation between the deflection T and a runout IR will be described. Note that the runout is a difference between a radius value RC1 at each phase and a minimum radius value Rmin, the difference being obtained when the radius, which is the distance from the rotation center of the workpiece W to a machined portion surface, is measured at each predetermined phase C1 of the outer periphery of the workpiece W. A runout IRC1 at the phase C1 is obtained by the equation, IRC1=RC1−Rmin. The difference between a maximum radius value Rmax and the minimum radius value Rmin is referred to as a maximum runout TIR (TIR=Rmax−Rmin).

Figure 4A:
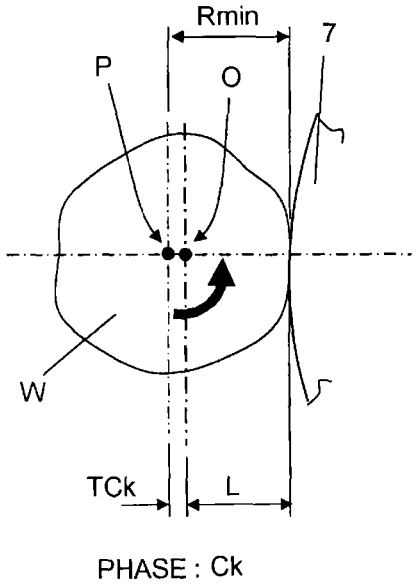
FIG. 4A and FIG. 4B show the correlation between a runout and a deflection.
Figure 4B:
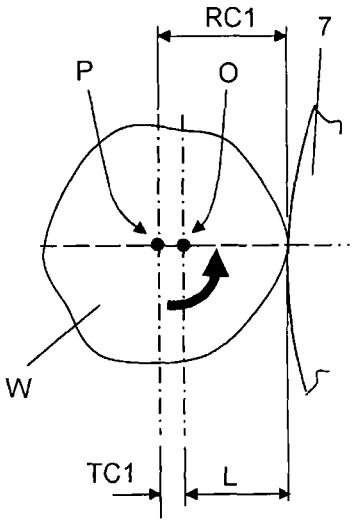

As shown in FIG. 4A and FIG. 4B, the rotation center of the workpiece W when the grinding wheel 7 is pushed against the workpiece W is defined as a point P, and a distance L between the surface of the grinding wheel 7 and a point O, which is the rotation center of the workpiece W when there is no deflection of the workpiece W, is constant. The radius Rmin of the workpiece W at a portion that contacts the grinding wheel 7 at a phase Ck in FIG. 4A is the minimum radius. A deflection TCk at the phase Ck is obtained by the equation, TCk=Rmin−L, and a deflection TC1 at the phase C1 in FIG. 4B is obtained by the equation, TC1=RC1−L. When the difference between the deflection TC1 at the phase C1 and the deflection TCk at the phase Ck is denoted by ΔTC1, the equation, ΔTC1=TC1−TCk=(RC1−L)−(Rmin−L)=RC1−Rmin, holds. As a result, the equation, IRC1=RC1−Rmin=ΔTC1, holds, and therefore the runout IRC1 is equal to the difference ΔTC1 in the deflection. Thus, it is possible to measure the runout if the difference in deflection is measured, and it is possible to reduce the runout if the difference in deflection is reduced. Accordingly, a difference ΔT in deflection is expressed by the equation, ΔT=ΔU×kg/km, using AU that is a difference in the actual grinding depth U. The correlation is established also at each phase during one rotation of the workpiece W, so the correlation at the phase C1 is expressed by the equation, ΔTC1=ΔUC1×kg/km. Accordingly, the equation, IRC1=ΔTC1=ΔUC1×kg/km, holds. Therefore, if a deviation ΔUC1 in the actual grinding depth U between the phases is measured, it is possible to obtain the runout IR.

The mechanical stiffness km and the grinding stiffness kg are measured through a test in advance. The measurement of the mechanical stiffness km is performed, for example, in the following manner. The grinding wheel 7 and the workpiece W are brought into contact with each other in a state where the rotation of the grinding wheel 7 is stopped, and a current value A0 of the motor 8 at this time is stored. Further, a current value A1 of the motor 8 is stored. The current value A1 is a current value when the grinding wheel head 3 is stopped after being advanced by a predetermined infeed Vg. The mechanical stiffness km in this case is calculated by the equation, km=C×(A1−A0)/Vg, where a thrust constant of the motor is C. The measurement of the grinding stiffness kg is performed as follows. The actual grinding depth U is measured by the above-described actual grinding depth measurement method while the grinding wheel 7 is advanced at a predetermined infeed speed and performing grinding, and a current value A3 of the motor 8 at this time is stored. Subsequently, a current value A2 of the motor 8 is stored. The current value A2 is a current value when the grinding wheel 7 is advanced at the same infeed speed without performing grinding. The grinding stiffness kg in this case is calculated by the equation, kg=C×(A3−A2)/U.

Conventional runout removal grinding will be described below. As described above, the runout of a workpiece is a variation in the radius position on the surface of the workpiece, which occurs in accordance with a rotation phase at the time when the workpiece is rotated with respect to a predetermined rotation reference. The runout of the workpiece occurs due to a radius variation or a bending of the shaft, and a large runout occurs due to the influence of a bending of the shaft in a workpiece having a complex shape, such as a crankshaft. A runout of a machined portion causes a variation in machining allowance, and a portion with a large runout has a large machining allowance. The degree of reduction in runout in the case where grinding is performed at a constant infeed speed is expressed by the equation, TIRn=TIR0×(1−km/kg)n, using the grinding stiffness kg and the mechanical stiffness km, where an initial maximum runout amount is TIR0 and a maximum runout amount after n rotations is TIRn. In normal grinding, the mechanical stiffness km is smaller than the grinding stiffness (km<kg). In the case of a workpiece that is long with respect to its diameter, because the mechanical stiffness km is much smaller than the grinding stiffness kg, the number of rotations required to remove the runout increases. In this case, the grinding stiffness km is increased by providing a runout prevention device.

Figure 5:
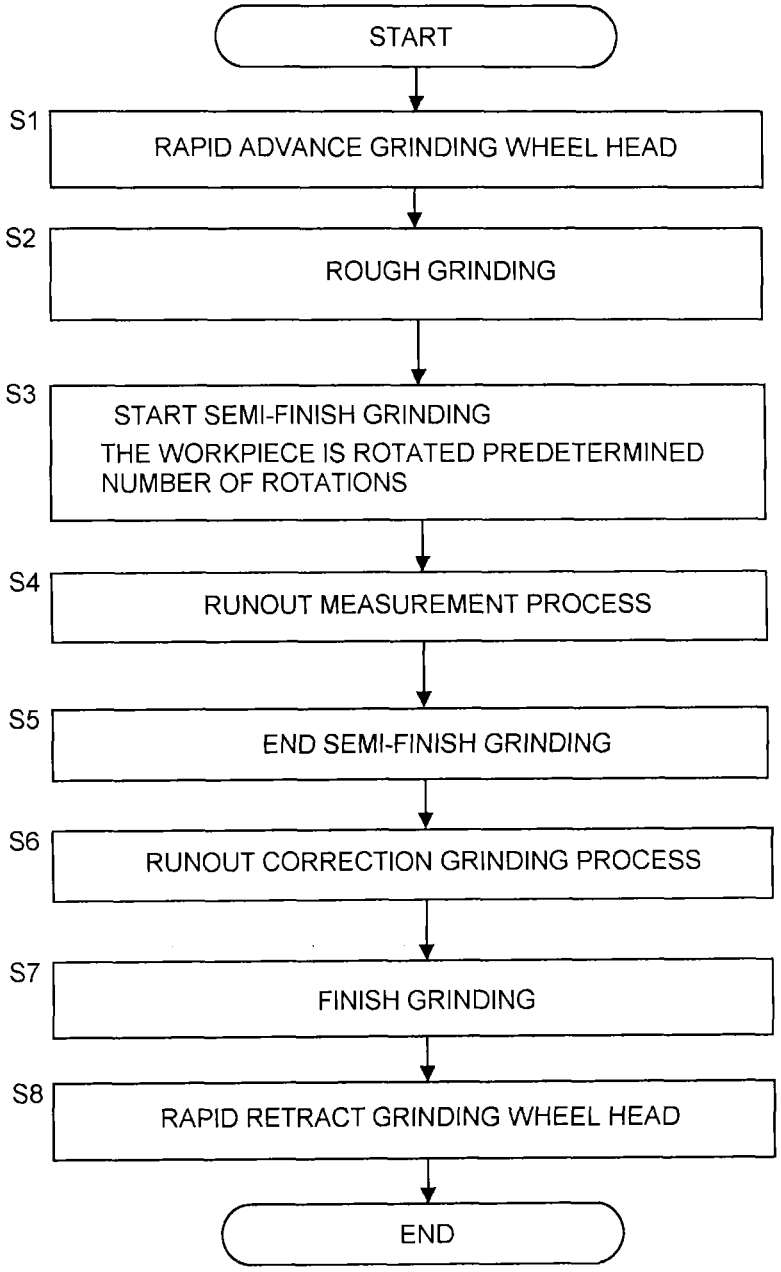
FIG. 5 is a flowchart that shows a grinding process according to the embodiment.

Hereinafter, description will be provided on a grinding process in which, in the grinding machine 1, the actual grinding depth U is measured during grinding and then a runout of the workpiece W is removed in a short period of time using the measured actual grinding depth U. First, a main process will be described with reference to the flowchart shown in FIG. 5. The mechanical stiffness km and the grinding stiffness kg are stored in the storage unit 351 in advance. In a state where the spindle 5 and the grinding wheel 7 are being rotated, the grinding wheel 7 is brought close to the workpiece W by rapid advancing the grinding wheel head 3 (S1). Then, rough grinding is performed such that the entire circumference of the workpiece W is ground at a predetermined feed speed of the grinding wheel head 3 (S2). A semi-finish grinding process is started, and the workpiece W is rotated a predetermined number of rotations (desirably, 3 to 5 rotations) (S3). A runout measurement process (described in detail later) is performed, and a runout amount at each phase of the workpiece W is measured (S4). Then, the semi-finish grinding process is ended (S5). A runout is removed by performing a runout correction grinding process (described in detail later) (S6). Then, a finish grinding process is performed (S7). Subsequently, the grinding wheel head 3 is rapidly retracted (S8).

Figure 6:
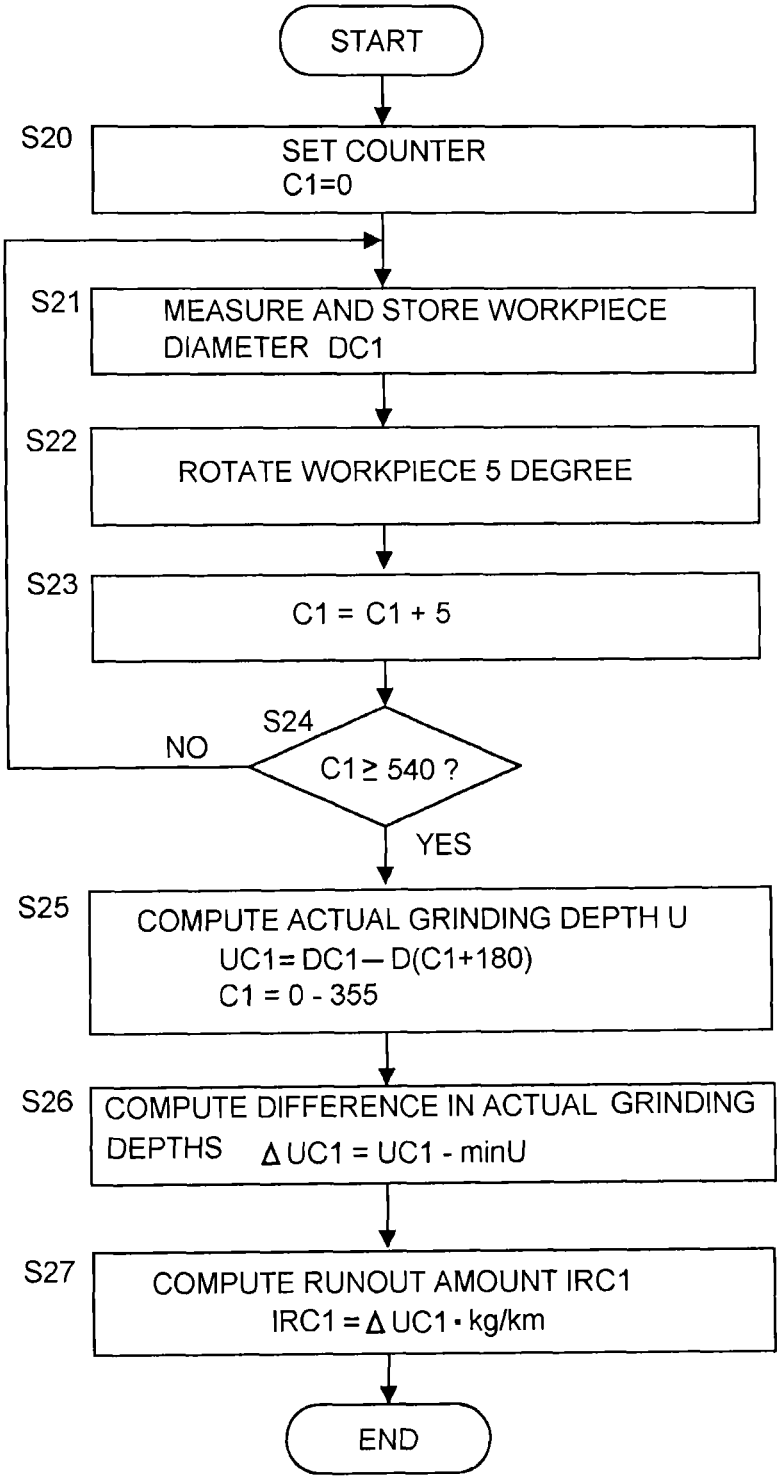
FIG. 6 is a flowchart that shows a runout measurement process according to the embodiment.

A runout measurement process of measuring a runout at each of the positions set at intervals of 5° on the circumference of the workpiece W will be described with reference to the flowchart in FIG. 6. The value of a counter C1 for counting the phase is set to 0 (S20). The diameter of the workpiece W, which is measured by the workpiece diameter measurement device 10 at the phase C1 of the workpiece W measured by the phase detector 9, is stored in the storage unit 351 as a workpiece diameter DC1 (S21). The spindle 5 is rotated 5° (S22). Five is added to the value of the counter C1 (S23). It is determined whether the value of the counter C1 is larger than or equal to 540 (S24). When it is determined that the value of the counter C1 is larger than or equal to 540 (C1≥540), the process proceeds to step S25. Otherwise, the process proceeds to step S21. The actual grinding depth U is computed by the computation unit 35. An actual grinding depth UC1 in the workpiece W at the phase C1 is computed for C1=0 to 355, according to the equation, UC1=DC1−D (C1+180), and is stored in the storage unit 351 (S25). A difference ΔU in the actual grinding depth is computed by the computation unit 35. A minimum actual grinding depth minU is selected from among the actual grinding depths UC1 (C1=0 to 355), the difference ΔUC1 is computed for C1=0 to 355, according to the equation, ΔUC1=UC1−minU, and is stored in the storage unit 351 (S26). A runout amount IRC1 is computed by the computation unit 35 for C1=0 to 355, according to the equation IRC1=ΔUC1×kg/km, and is stored in the storage unit 351 (S27).

Figure 7:
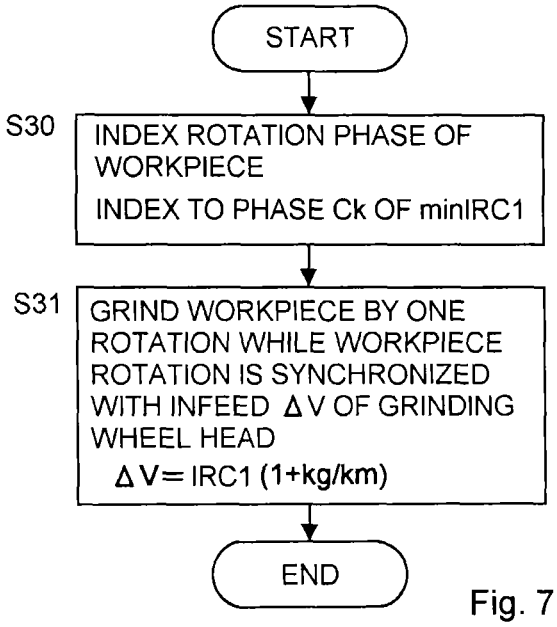
FIG. 7 is a flowchart that shows a runout correction grinding process according to the embodiment.

A runout correction grinding process will be described with reference to the flowchart in FIG. 7. The rotation phase of the workpiece W is indexed to a runout correction grinding start position (the phase of the workpiece W is set to the phase Ck at the minimum runout amount minIR, and the position of the grinding wheel head 3 is set to the position at which semi-finish grinding ends) (S30). With reference to the runout correction grinding start position, grinding is performed for one rotation of the workpiece W while the rotation of the spindle 5 is synchronized with an infeed ΔV of the grinding wheel head 3. An amount of infeed ΔVC1 of the grinding wheel head 3 at the phase C1 of the workpiece W is obtained by the equation, ΔVC1=IRC1×(1+kg/km). Where an amount of increase in the actual grinding depth, which is required for runout correction, is ΔUsC1 and an amount of increase in the deflection amount at this time is ΔTsC1, an amount of increase in the infeed is expressed by the equation, ΔVC1=ΔUsC1+ΔTsC1. Because the equation, ΔTsC1=ΔUsC1×kg/km, holds, the equation, ΔVC1=ΔUsC1+ΔUsC1×kg/km holds. The amount of increase ΔUsC1 in the actual grinding depth, which is required for removing the runout, is the runout amount IRC1 measured in the runout measurement process. Therefore, ΔUsC1 is replaced with the runout amount IRC1, and therefore, the equation, ΔVC1=IRC1+IRC1×kg/km=IRC1×(1+kg/km), holds. Thus, the infeed ΔV of the grinding wheel head 3 is ΔVCk=0 at the runout correction grinding start position, and gradually increases with the rotation of the workpiece W. After reaching a maximum infeed, the infeed ΔV of the grinding wheel head 3 gradually decreases, and becomes ΔVCk=0 again at the runout correction grinding start position (S31).

As described above, with the actual grinding depth measurement method and machining method according to the invention, it is possible to remove the runout of the workpiece by one rotation without using a runout prevention device. Because the runout prevention device is no longer necessary, adjustment of the runout prevention device and change for each workpiece are no longer necessary. Therefore, the grinding time required for runout reduction is also reduced and, as a result, it is possible to provide a grinding machine having a high machining efficiency.

Figure 8:
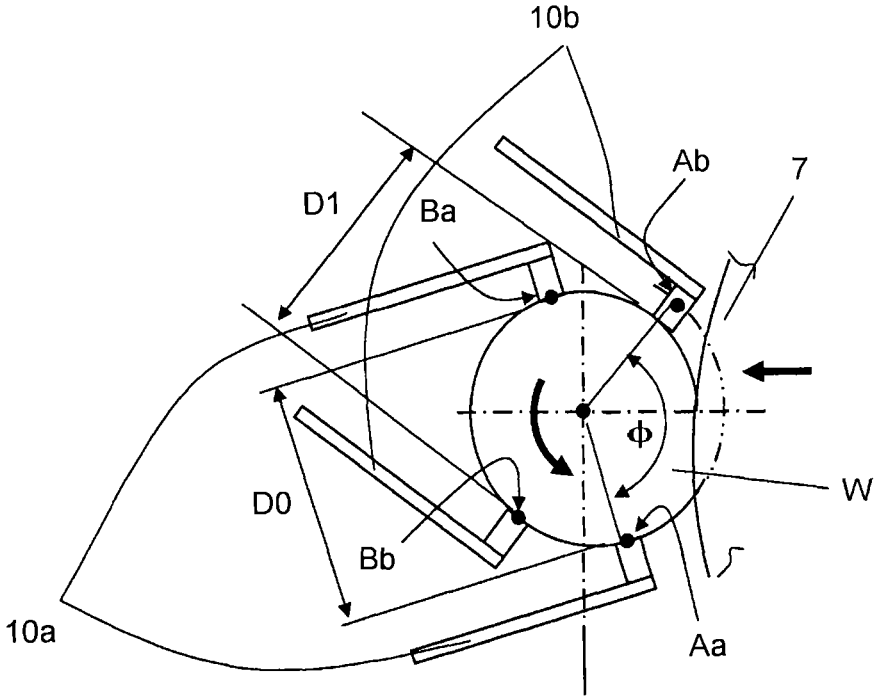
FIG. 8 is a view that shows a measurement method according to another embodiment of the invention.

In the above-described embodiment, the invention is applied to grinding of the outer periphery of a cylindrical workpiece. Alternatively, the invention may be applied grinding of the inner periphery of a cylindrical workpiece, or machining that is performed with the use of a cutting tool. In the above-described embodiment, the single workpiece diameter measurement device 10 is used and an actual grinding depth is computed from the difference between the initially measured workpiece diameter and the workpiece diameter measured at time after the workpiece is rotated 180° from the initial measurement time. Alternatively, as shown in FIG. 8, a difference in workpiece diameter may be measured with the use of two workpiece diameter measurement devices 10*a*, 10*b* arranged at an angular difference of Φ. In this case, a diameter D1 is measured by the workpiece diameter measurement device 10*b* after the workpiece is rotated by Φ from time at which a diameter D0 is measured by the workpiece diameter measurement device 10*a*, and an actual grinding depth is computed from the difference between the respectively measured workpiece diameters. By setting Φ to a value smaller than 180°, it is possible to compute an actual grinding depth in a shorter period of time, and it is possible to obtain a quick response of control in the grinding process. When the interval of the phase at which correction is made is reduced, measurement may be performed at an interval smaller than 5°, and ΔVC1 may be obtained by performing interpolation calculation at a desired phase interval in an intermediate phase between measurement points.

What is claimed is:

1. An actual grinding depth measurement method of measuring an actual grinding depth achieved by a machining application portion of a tool while a cylindrical machined portion of a workpiece is machined using a machine tool that supports the workpiece such that the workpiece is rotatable about a shaft center of the cylindrical machined portion, and that feeds the tool in a radial direction of the cylindrical machined portion, comprising:

a diameter measurement start step of measuring a start diameter (D0) that is a distance between a measurement start point that is one of intersections between an axis line perpendicular to the shaft center and a surface of the cylindrical machined portion and a measurement end point that is the other one of the intersections, using a measuring device that detects surfaces of the workpiece that are separated from one another by 180° of rotation of the workpiece;

a diameter measurement end step of measuring an end diameter (D1) that is a diameter of the cylindrical machined portion, the end diameter including the measurement end point, after the measurement start point first passes through the machining application portion following the diameter measurement start step and before the measurement end point first passes through the machining application portion following the diameter measurement start step, using the measuring device that detects surfaces of the workpiece that are separated from one another by 180° of rotation of the workpiece; and an actual grinding depth computing step of computing an actual grinding depth (U) at the time when the measurement start point is machined, according to an equation, U=|D0−D1|, wherein the diameter measurement end step is executed when the workpiece is rotated 180° from when the diameter measurement start step ends.

2. A machining method of machining a cylindrical machined portion of a workpiece supported so as to be rotatable about a shaft center of the cylindrical machined portion by feeding a tool in a radial direction of the cylindrical machined portion, wherein a machining operation is controlled using the actual grinding depth (U) computed by the actual grinding depth measurement method according to claim 1.

3. The machining method according to claim 2, wherein, in the machining operation, a runout of the cylindrical machined portion is computed from a relative difference in the actual grinding depth (U) between positions of the cylindrical machined portion in a rotational direction, and tool infeed control for removing the runout is executed.

4. A machine tool that supports a workpiece having a cylindrical machined portion such that the workpiece rotates about a shaft center of the cylindrical machined portion, and that feeds a tool in a radial direction of the cylindrical machined portion, comprising:

a workpiece diameter measurement device that measures a diameter of the cylindrical machined portion; and an actual grinding depth computing device that computes an actual grinding depth (U) based on the actual grinding depth measurement method according to claim 1.

5. An actual grinding depth measurement method of measuring an actual grinding depth achieved by a machining application portion of a tool while a cylindrical machined portion of a workpiece is machined using a machine tool that supports the workpiece such that the workpiece is rotatable about a shaft center of the cylindrical machined portion, and that feeds the tool in a radial direction of the cylindrical machined portion, and that has two workpiece diameter measurement devices arranged at an angular difference smaller than 180°, comprising:

a diameter measurement start step of measuring a start diameter (D0) that is a distance between a measurement start point that is one of intersections between an axis line perpendicular to the shaft center and a surface of the cylindrical machined portion and a measurement end point that is the other one of the intersections, the measuring a start diameter performed by a first workpiece diameter measurement device;

a diameter measurement end step of measuring an end diameter (D1) that is a diameter of the cylindrical machined portion, the end diameter including the measurement end point, after the measurement start point passes through the machining application portion following the diameter measurement start step and before the measurement end point passes through the machining application portion following the diameter measurement start step, the measuring an end diameter performed by a second workpiece diameter measurement device; and an actual grinding depth computing step of computing an actual grinding depth (U) at the time when the measurement start point is machined, according to an equation U=|D0−D1|.

6. A machine tool that supports a workpiece having a cylindrical machined portion such that the workpiece rotates about a shaft center of the cylindrical machined portion, and that feeds a tool in a radial direction of the cylindrical machined portion, comprising:

two workpiece diameter measurement devices that measure a diameter of the cylindrical machined portion; and an actual grinding depth computing device that computes an actual grinding depth (U) based on the actual grinding depth measurement method according to claim 5.

* * * * *